US008486205B2

(12) United States Patent
Satou et al.

(10) Patent No.: US 8,486,205 B2
(45) Date of Patent: Jul. 16, 2013

(54) HIGH STRENGTH HOT ROLLED STEEL SHEET EXCELLENT IN BORE EXPANDING WORKABILITY AND METHOD FOR PRODUCTION THEREOF

(75) Inventors: Motoo Satou, Kakogawa (JP); Tetsuo Soshiroda, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/210,807

(22) Filed: Aug. 16, 2011

(65) Prior Publication Data

US 2011/0297281 A1 Dec. 8, 2011

Related U.S. Application Data

(62) Division of application No. 11/908,423, filed as application No. PCT/JP2006/305700 on Mar. 22, 2006, now Pat. No. 8,038,809.

(30) Foreign Application Priority Data

Mar. 28, 2005 (JP) ..... 2005-092610
Mar. 28, 2005 (JP) ..... 2005-092611

(51) Int. Cl.
*C22C 38/44* (2006.01)
*C22C 38/48* (2006.01)
*C22C 38/50* (2006.01)

(52) U.S. Cl.
USPC ..... 148/334; 148/333; 148/335; 148/602; 148/654

(58) Field of Classification Search
USPC ..... 148/320, 330, 332–336, 602, 654
See application file for complete search history.

(56) References Cited

U.S. PATENT DOCUMENTS

| | | | | |
|---|---|---|---|---|
| 6,364,968 | B1 | 4/2002 | Yasuhara et al. | |
| 2001/0004910 | A1 * | 6/2001 | Yasuhara et al. | 148/546 |
| 2009/0136378 | A1 | 5/2009 | Satou et al. | |

FOREIGN PATENT DOCUMENTS

| | | | |
|---|---|---|---|
| CN | 1394237 | | 1/2003 |
| EP | 1 195 447 | A1 | 4/2002 |
| EP | 1 201 780 | A1 | 5/2002 |
| JP | 8 143952 | | 6/1996 |
| JP | 2000 87143 | | 3/2000 |
| JP | 2000 282175 | | 10/2000 |
| JP | 2003 155541 | | 5/2003 |
| JP | 2003 342684 | | 12/2003 |
| JP | 3546266 | | 7/2004 |

(Continued)

OTHER PUBLICATIONS

Machine-English translation of Japanese patent No. 2004-244651, Akamatsu Satoshi et al., Sep. 2, 2004.*

(Continued)

*Primary Examiner* — Deborah Yee
(74) *Attorney, Agent, or Firm* — Oblon, Spivak, McClelland, Maier & Neustadt, L.L.P.

(57) ABSTRACT

A high-strength hot-rolled steel sheet containing C: 0.05 to 0.15%, Si: no more than 1.50% (excluding 0%), Mn: 0.5 to 2.5%, P: no more than 0.035% (excluding 0%), S: no more than 0.01% (including 0%), Al: 0.02 to 0.15%, and Ti: 0.05 to 0.2%, which is characterized in that its metallographic structure is composed of 60 to 95 vol % of bainite and solid solution-hardened or precipitation-hardened ferrite (or ferrite and martensite) and its fracture appearance transition temperature (vTrs) is no higher than 0° C. as obtained by impact tests (% in terms of % by weight).

11 Claims, 4 Drawing Sheets

FOREIGN PATENT DOCUMENTS

| | | |
|---|---|---|
| JP | 2004 225109 | 8/2004 |
| JP | 2004 250749 | 9/2004 |
| JP | 2004 339606 | 12/2004 |
| JP | 3602350 | 12/2004 |
| JP | 2005 15854 | 1/2005 |
| WO | 03 010351 | 2/2003 |

OTHER PUBLICATIONS

V.I. Slavov, et al., "Impact of Coil Cooling Rate on Texture, Special Boundaries and Properties of Hot Rolled Strip", Material Science Forum, XP009110567, vol. 467/470, No. part 1, Jan. 1, 2004, pp. 323-328.

Office Action issued Jun. 15, 2011, in Chinese Patent Application No. 201010271326.X, filed Sep. 1, 2010 (with English Language Translation).

Office Action issued Mar. 17, 2011, in Chinese Patent Application No. 200680004681.2 , filed Mar. 22, 2006 (with English language translation).

Machine-English translation of Japanese Patent 06-172920, Hosoda Takuo et al., Jun. 21, 1994.

Machine-English translation of Japanese Patent 2000-282175, Kawabe Hidenao et al. Oct. 10, 2000.

* cited by examiner

HIGH STRENGTH HOT ROLLED STEEL SHEET EXCELLENT IN BORE EXPANDING WORKABILITY AND METHOD FOR PRODUCTION THEREOF

CROSS REFERENCE TO RELATED APPLICATIONS

This application is a divisional of U.S. patent application Ser. No. 11/908,423, filed Sep. 12, 2007 now U.S. Pat. No. 8,038,809 which is the U.S. national stage of International Application No. PCT/JP2006/305700, filed Mar. 22, 2006, the disclosures of which are incorporated herein by reference in their entireties. This application claims priority to Japanese Patent Application JP2005-096210, filed Mar. 28, 2005 and to Japanese Patent Application JP2005-092611, filed Mar. 28, 2005, the disclosures of which are incorporated herein by reference in their entireties.

TECHNICAL FIELD

The present invention relates to a high-strength hot-rolled steel sheet and a method for production thereof, said steel sheet being used for automobiles (such as passenger cars and trucks) and industrial machines. Because of its excellent hole expandability, the steel sheet finds use as a material for parts in various applications.

BACKGROUND ART

There is an increasing demand for high-strength hot-rolled steel sheet (with a tensile strength higher than 780 MPa) for automobiles from the standpoint of weight reduction (which leads to energy saving and good fuel economy) and improved safety in case of collision. The high-strength hot-rolled steel sheet for such uses is required to have good drawability as well as hole expandability. Thus there have been proposed several techniques to meet these requirements.

Among known high-strength hot-rolled steel sheets is the one which has a composite structure composed of residual austenite and martensite. For example, Patent Document 1 discloses a method of improving hole expandability of steel sheet of composite structure composed of ferrite, bainite, residual-austenite, and martensite by extremely reducing the P content, controlling the maximum size of microstructure and inclusions, and controlling the hardness of microstructure.

Patent Document 2 discloses a high-strength steel sheet of ferrite-bainite structure (with ferrite dominating) which contains an adequately controlled amount of unfixed carbon (which remains unreacted with Ti and Nb in steel) and unprecipitated carbon (which precipitates in grain boundaries at the time of ageing to increase strength). Patent Document 3 discloses a method of improving hole expandability by turning a high-strength hot-rolled steel sheet into one which has microstructure composed of ferrite (as a major component) and bainitic ferrite and polygonal ferrite. The disclosed method involves the condition and technique of cooling the hot-rolled sheet in the coiling step which are necessary to form the above-mentioned microstructure.

Patent Document 4 also discloses a method of improving hole expandability by turning a high-strength hot-rolled steel sheet into the one which has microstructure composed of bainitic ferrite and polygonal ferrite. The disclosed method involves the condition and technique of cooling the hot-rolled sheet in the coiling step which are necessary to form the above-mentioned microstructure.

Unfortunately, the techniques proposes so far are not able to improve hole expandability as desired.

Patent Document 1:

Published Japanese Translation of PCT No. 2004-536965

Patent Document 2:

Japanese Patent Laid-open No. 2003-342684

Patent Document 3:

Japanese Patent Laid-open No. 2004-250749

Patent Document 4:

Japanese Patent Laid-open No. 2004-225109

DISCLOSURE OF THE INVENTION

The present invention was completed in order to tackle problems involved in conventional high-strength hot-rolled steel sheets mentioned above. It is an object of the present invention to provide a high-strength hot-rolled steel sheet (having a tensile strength no lower than 780 MPa) characterized by excellent drawability and hole expandability and also to provide a method for producing such a high-strength hot-rolled steel sheet.

The high-strength hot-rolled steel sheet according to the present invention contains C: 0.05 to 0.15%, Si: no more than 1.50% (excluding 0%), Mn: 0.5 to 2.5%, P: no more than 0.035% (excluding 0%), S: no more than 0.01% (including 0%), Al: 0.02 to 0.15%, and Ti: 0.05 to 0.2%, with its metallographic structure being composed of 60 to 95 vol % of bainite and solid solution-hardened or precipitation-hardened ferrite or ferrite and martensite and its fracture appearance transition temperature (vTrs) being no higher than 0° C. as obtained by impact tests. (% in terms of % by weight)

The high-strength hot-rolled steel sheet according to the present invention may additionally contain any one of such optional elements as (a) Ni: no more than 1.0% (excluding 0%), (b) Cr: no more than 1.0% (excluding 0%), (c) Mo: no more than 0.5% (excluding 0%), (d) Nb: no more than 0.1%) (excluding 0%), B: no more than 0.01% (excluding 0%), (f) Ca: no more than 0.01% (excluding 0%), and (g) Cu: no more than 1.0% (excluding 0%). It varies in characteristic properties depending on optional elements added thereto.

The high-strength hot-rolled steel sheet defined above may be produced by a method which comprises a step of heating a steel slab containing the above-mentioned chemical components at 1150 to 1300° C., a step of hot-rolling the heated steel slab at a finish temperature above $Ar_3$ transformation point, a step of cooling the hot-rolled steel sheet down to 400-550° C. at an average cooling rate no smaller than 30° C./sec, followed by coiling, and a step of cooling the coiled steel sheet down to a temperature no higher than 300° C. at an average cooling rate of 50-400° C./hour.

The high-strength hot-rolled steel sheet defined above contains C: 0.02 to 0.10%, Si: no more than 1.50% (excluding 0%), Mn: 0.5 to 2.0%, P: no more than 0.025% (excluding 0%), S: no more than 0.01% (including 0%), Al: 0.020 to 0.15%, Ni: no more than 1% (excluding 0%), Cr: no more than 1% (excluding 0%), Nb: no more than 0.08% (excluding 0%), and Ti: 0.05 to 0.2%, with its metallographic structure being substantially a single phase of ferrite and its fracture appearance transition temperature (vTrs) being no higher than 0° C. as obtained by impact tests. (% in terms of % by weight)

The high-strength hot-rolled steel sheet according to the present invention may additionally contain any one of such optional elements as (a) Mo: no more than 0.5% (excluding 0%), (b) Cu: no more than 1.0% (excluding 0%), (c) B: no more than 0.01% (excluding 0%), and (d) Ca: no more than 0.005% (excluding 0%). It varies in characteristic properties depending on optional elements added thereto. The amount of Mo should be so established as to satisfy the equation (1) below.

$$([Mo]/96)/([P]/31) \geqq 1.0 \quad (1)$$

where, [Mo] and [P] represent the content (in wt %) of Mo and P, respectively.

The high-strength hot-rolled steel sheet defined above may be produced by a method which comprises a step of heating a steel slab containing the above-mentioned chemical components at 1150 to 1300° C., a step of hot-rolling the heated steel slab at a finish temperature above $Ar_3$ transformation point, a step of cooling the hot-rolled steel sheet down to 500-650° C. at an average cooling rate no smaller than 30° C./sec, followed by coiling, and a step of cooling the coiled steel sheet down to a temperature no higher than 300° C. at an average cooling rate of 50-400° C./hour.

EFFECT OF THE INVENTION

The high-strength hot-rolled steel sheet according to the present invention has excellent drawability and hole expandability owing to the properly controlled chemical composition, microstructure, and fracture appearance transition temperature (vTrs). With a thickness of 2 mm, it has a tensile strength no lower than 780 MPa, an elongation no lower than 20%, and a hole expandability larger than 60%. It can be applied to various parts for automobiles and industrial machines to which conventional hot-rolled steel sheets were not applied because of their inadequate moldability. Therefore, it contributes to cost reduction of parts, thickness reduction of parts, and improvement in automotive safety (in case of collision), and it eventually contributes to improvement in performance of automobiles.

BEST MODE FOR CARRYING OUT THE INVENTION

Embodiment 1

The present inventors carried out extensive studies from every angle in order to realize the high-strength hot-rolled steel sheet with excellent hole expandability. As the result, it was found that a steel sheet with a tensile strength no lower than 780 MPa is realized if it has an adequate chemical composition and it is produced in such a way that its microstructure is composed of 60-95 vol % of bainite, with the remainder being ferrite (or ferrite plus martensite) containing fine precipitates of TiC and/or Nb or Mo carbide. In addition, it was also found that the hot-rolled steel sheet has good hole expandability if the coiled steel sheet is cooled under adequate conditions so that it has an adequate fracture appearance transition temperature (vTrs) measured by impact tests. These findings led to the present invention. The effect of the present invention will be described with reference to the way in which the present invention was completed.

If a steel sheet having a tensile strength no lower than 780 MPa is to have improved drawability and hole-expanding workability (referred to as "hole expandability" hereinafter), it should contain as little carbon as possible, have the bainite structure as the main phase, and contain the solid solution-hardened or precipitation-hardened ferrite structure in an adequate volume ratio. Reduced carbon content lowers the hardness of bainite and improves the ductility of bainite and also decreases difference in hardness between bainite and solid solution-hardened or precipitation-hardened ferrite. This is a probable reason for high drawability and high hole expandability. However, hole expandability varies from one coil to another even though the hot-rolled steel sheet is the same in composition and manufacturing condition.

Figure 1:
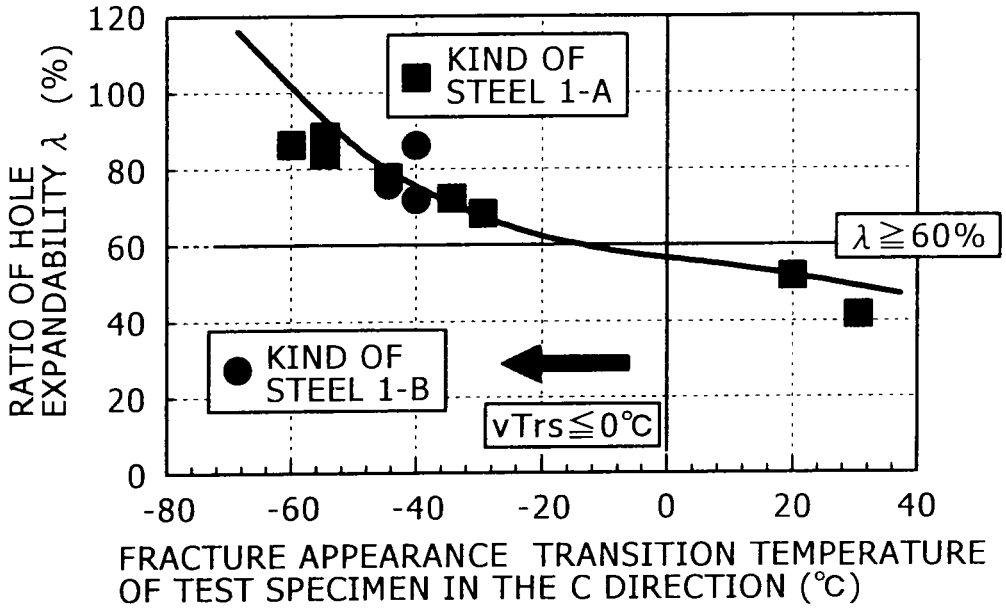
FIG. 1 is a graph showing the relation between the fracture appearance transition temperature (vTrs) and the ratio of hole expandability (λ) in Example 1.

The present inventors investigated the relation between the hole expandability and the fracture appearance transition temperature (vTrs) measured by impact tests on the assumption that the former is related with toughness. The existence of a close relation between them was found. The results of investigation suggest that good hole expandability (larger than 60%) is obtained if the steel sheet is produced such that it has a fracture appearance transition temperature (vTrs) no higher than 0° C. (See FIGS. 1 and 3.) The hole expandability is measured by the method mentioned later.

A sample of steel sheet with a high fracture appearance transition temperature (vTrs) (or a low value of toughness) was examined in more detail. The results indicate that low-temperature fracture leads to intergranular fracture and intergranular segregation of P takes place in intergranular fracture surfaces according to auger analysis. By contrast, a sample of steel sheet with good toughness (or a low fracture appearance transition temperature) merely undergoes cleavage fracture even in case of low-temperature fracture, without intergranular segregation of any element.

Figure 4:
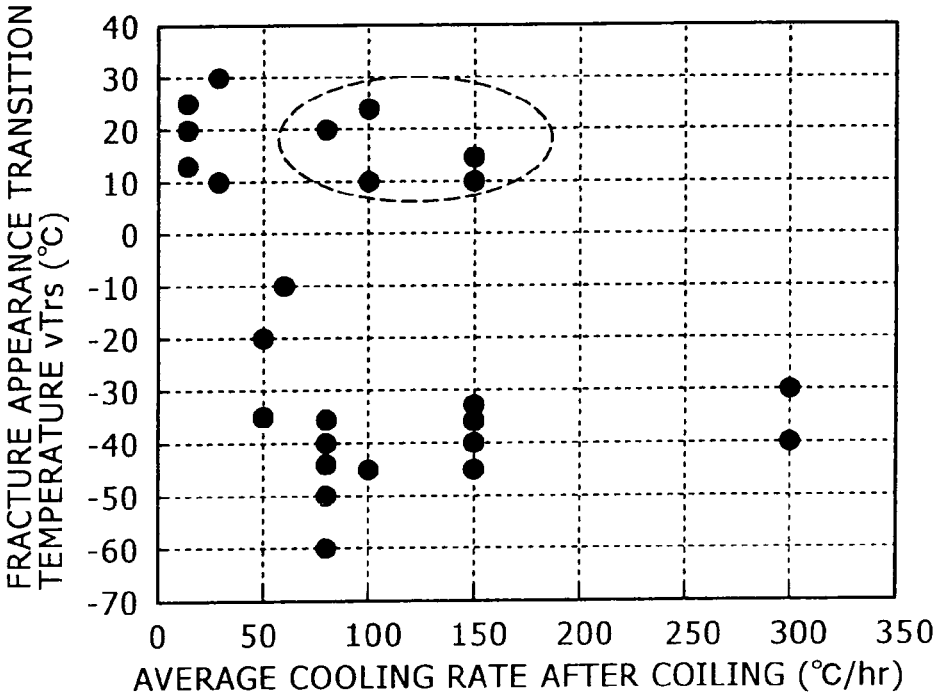
FIG. 4 is a graph showing the relation between cooling rate after coiling and the fracture appearance transition temperature (vTrs) in Example 2.

It is considered that segregation of P in grain boundaries is due to the fact that grain boundaries become more unstable than the inside of grains when the steel coil is cooled slowly. The present inventors continued their studies in the belief that toughness can be improved by suppressing segregation of P. The present inventors continued their researches assuming that the object would be achieved by reducing time for diffusion and pursued practical means from every angle. The results of their researches indicate that a hot-rolled steel sheet decreases in fracture appearance transition temperature (vTrs) and increases in toughness if it is cooled (after coiling) at an average cooling rate no smaller than 50° C./hr until it is cooled to a temperature below 300° C. (See FIGS. 2 and 4.)

The hot-rolled steel sheet according to the present invention is required to have an adequately controlled chemical composition so that it exhibits desirable fundamental mechanical properties, such as yield strength (YS), tensile strength (TS), and elongation (EL). The range of chemical composition specified in the present invention was established for the following reasons.

C: 0.05 to 0.15%

C is a basic component (element) to impart strength. For the steel sheet to have a tensile strength no lower than 780 MPa, it should contain C in an amount no less than 0.05%. However, with a C content exceeding 0.15%, the steel sheet is poor in hole expandability because it allows its microstructure to produce a second phase (such as martensite) other than ferrite. The C content should preferably be no higher than 0.06% and no lower than 0.10%.

Si: No More than 1.5% (Excluding 0%)

Si promotes the formation of polygonal ferrite and keeps strength without reducing elongation and hole expandability. This effect is proportional to the Si content; however, excessive Si deteriorates the surface state of steel sheets and increases resistance to deformation during hot rolling, thereby hindering smooth production of steel sheets. The Si content should be no more than 1.5%. It should preferably be no less than 0.2% and no more than 1.0%.

Mn: 0.5 to 2.5%

Mn is necessary for solution-hardening of steel. For the steel sheet to have a tensile strength no lower than 780 MPa, it should contain Mn in an amount of at least 0.5%. However, excessive Mn enhances hardenability too much and gives rise to a large amount of transformation products, thereby adversely affecting hole expandability. The Mn content should be no more than 2.5%. It should preferably be no less than 1.4% and no more than 2.3%.

P: No More than 0.035% (Excluding 0%)

P enhances solution-hardening without adverse effect on ductility. P plays an important role in the present invention. However, excessive P segregates in grain boundaries during cooling after coiling, thereby deteriorating toughness and increasing the fracture appearance transition temperature (vTrs). Therefore, the P content should be no more than 0.035%. It should preferably be no more than 0.025%.

S: No More than 0.01% (Including 0%)

S is an element that inevitably enters during the manufacturing process. It forms sulfide inclusions, which adversely affect hole expandability. Therefore, the S content should be as low as possible, or no more than 0.01%. It should be no more than 0.008%, preferably no more than 0.005%.

Al: 0.02 to 0.15%

Al is an element that is added for deoxidation during steel melting. It effectively improves the cleanliness of steel. For Al to produce its effect, it should be added in an amount no less than 0.02%. However, excessive Al gives rise to a large amount of alumina inclusions, which deteriorates the steel surface. Therefore, the Al content should be no more than 0.15%. It should preferably be no less than 0.025% and no more than 0.06%.

Ti: 0.05 to 0.2%

Ti causes C and N to precipitate in ferrite allowing ferrite to undergo precipitation hardening and decreases the amount of dissolved C and cementite in ferrite, thereby improving hole expandability. It plays an important role for the steel sheet to have a tensile strength no lower than 780 MPa. For these effects, the Ti content should be no less than 0.05%. However, excessive Ti deteriorates ductility and produces no additional effects. The Ti content should be no more than 0.2%. It should preferably be no less than 0.08% and no more than 0.18%.

The hot-rolled steel sheet according to the present invention is composed of the above-mentioned components and Fe, with the remainder being inevitable impurities (such as V and Sn). However, it may additionally contain any of optional elements such as Ni, Cr, Mo, Nb, B, Ca, and Cu, according to need. The range of their content was established for the following reasons.

Ni: No More than 1% (Excluding 0%)

Ni enhances solution-hardening. However, excessive Ni is wasted without additional effects. The Ni content should be no more than 1%. Ni produces its effect in proportion to its content. For the steel sheet with ferrite single-phase structure to have a tensile strength no lower than 780 MPa, the Ni content should be at least 0.1%, preferably no less than 0.2%. Also, the Ni content should be no more than 0.8%, preferably no more than 0.5%.

Cr: No More than 1.0% (Excluding 0%)

Cr allows C to precipitate in steel for precipitation hardening and strengthens ferrite. However, excessive Cr is wasted without additional effects. The Cr content should be no more than 1.0%. Cr produces its effect in proportion to its content. For Cr to produce its effect, the Cr content should be no less than 0.1%, preferably no less than 0.2%. Also, the Cr content should be no more than 0.8%, preferably no more than 0.5%.

Mo: No More than 0.5% (Excluding 0%)

Mo precipitates in ferrite in the form of carbide, and it plays an important role in the precipitation-hardening of ferrite. It also prevents P from segregating in ferrite grain boundaries. Segregation of P reduces toughness and increases the fracture appearance transition temperature (vTrs). It produces its effect in proportion to its content but excessive Mo does not produce additional effect. The adequate Mo content should be no more than 0.5%.

Nb: No More than 0.1% (Excluding 0%)

Nb makes fine the ferrite which has occurred from austenite after hot rolling, thereby improving hole expandability. It also causes C and N to precipitate in steel for precipitation hardening, thereby strengthening ferrite. It produces its effect more in proportion to its content. However, excessive Nb is wasted without additional effects. The Nb content should be no more than 0.1%. For Nb to produce its effect as mentioned above, the Nb content should be no less than 0.01%, preferably no less than 0.02%. The upper limit of the Nb content should be 0.08%, preferably 0.07%.

B: No More than 0.01% (Excluding 0%)

B reduces intergranular energy of steel and prevents intergranular segregation of P. It produces its effect more in proportion to its content. However, excess B does not produce additional effect. A desirable B content is no more than 0.01%. The desirable lower limit and upper limit of B content is 0.001% and 0.005%, respectively.

Ca: No More than 0.01% (Excluding 0%)

Ca makes sulfides in steel sheet spherical, thereby improving hole expandability. Since excessive Ca does not produce additional effect, an adequate content of Ca should be no more than 0.01%. For Ca to be fully effective, the Ca content should be no less than 0.001%. The upper limit of Ca content is 0.005%.

Cu: No More than 1.0% (Excluding 0%)

When added in conjunction with Ti and Nb, Cu causes TiC and NbC to precipitate in the form of uniform fine particles, thereby allowing precipitation hardening and improving hole expandability. Excessive Cu is wasted without additional effect. An adequate Cu content is no more than 1.0%. Although Cu produces its effect in proportion to its amount, for Cu to be fully effective, its content should be no less than 0.1%, preferably no less than 0.3%. The upper limit of Cu content is 0.8%.

For the hot-rolled steel sheet according to the present invention to have high strength, good hole expandability, and good ductility, it should have an adequate metallographic structure. High strength and good hole expandability require that the steel sheet be composed of bainite as the main phase which has high strength and yet has a smaller difference in hardness from ferrite than martensite, and good ductility requires that the steel sheet contain sufficient ferrite. Thus the steel sheet should have a metallographic structure in which the bainite phase accounts for 60 to 95 vol %, so that it has high strength as well as good workability.

The steel sheet according to the present invention should have a metallographic structure composed basically of bainite and ferrite, with ferrite partly replaced by martensite if necessary. In the present invention, the term "ferrite" embraces polygonal ferrite and pseudo-polygonal ferrite and the term "bainite" embraces acicular ferrite and bainitic ferrite, both of which have a high density of transformation.

The manufacturing method according to the present invention will be described below. The method for producing the high-strength hot-rolled steel sheet according to the present invention needs an adequate control for cooling rate after coiling, as mentioned above. Except for cooling rate, ordinary conditions are applied to hot rolling. Basic conditions for the manufacturing method are as follows.

Production of the high-strength hot-rolled steel sheet according to the present invention starts with preparing a slab having the chemical composition as mentioned above in the usual way, and then the slab undergoes hot rolling into a steel sheet. Prior to hot rolling, the slab should be heated above 1150° C. so that Ti and Nb added to the steel completely dissolve in the steel. (In other words, heating at this temperature causes TiC and Nb(C,N) to dissolve in austenite.) The resulting solid solution of Ti and Nb reacts with dissolved C and N in ferrite when ferrite is formed after completion of hot rolling, and the resulting compounds precipitate so that the steel sheet undergoes precipitation hardening, which is necessary for the steel to have the desired tensile strength. The heating temperature should be no higher than 1300° C.; an excessively high heating temperature leads to damage to the heating furnace and increase in energy cost.

The hot rolling may be accomplished in the usual way without specific restrictions. However, the finishing temperature of hot rolling should be higher than the $Ar_3$ transformation point at which the single phase of austenite exists. When the temperature of hot rolling is lower than the $Ar_3$ transformation point, the resulting steel sheet has the ferrite-austenite dual structure with worked ferrite remaining and hence is poor in ductility and hole expandability. Moreover, it has a coarse structure on its surface, resulting in poor elongation. In addition, hot rolling at a low temperature causes dissolved Nb and Ti to precipitate in the form of carbonitride, and the resulting precipitates do not contribute to strength. Precipitates in ferrite do not contribute to ferrite strength, and the amount for precipitation hardening (which is the original object of addition) decreases, thereby preventing the steel sheet from acquiring the desired strength.

After completion of hot rolling, the rolled steel sheet should be cooled at an average cooling rate greater than 30° C./s until it cools to the coiling temperature of 400-550° C. Cooling in this manner is necessary for the steel sheet to have a uniform fine bainite structure resulting from austenite and to have improved ductility and hole expandability. Cooling at an average cooling rate smaller than 30° C./s causes ferrite to become coarse after transformation and gives rise to coarse carbides in bainite, making the steel sheet poor in ductility and hole expandability.

The coiling temperature should be 400 to 550° C. so that the steel sheet has the microstructure composed mainly of bainite. With a coiling temperature lower than 400° C., the steel sheet has a martensite structure and is poor in hole expandability. Moreover, the steel sheet lacks carbonitrides for precipitation hardening and hence is poor in strength.

By contrast, with a coiling temperature exceeding 550° C., the steel sheet causes cementite to precipitate and gets the pearlite structure involved, resulting in reduced strength and hole expandability. For this reason, the coiling temperature should be 400-550° C., preferably 400-500° C.

The coiled steel sheet should be cooled at an average cooling rate greater than 50° C./hr until it cools below 300° C. Cooling in this way is necessary to prevent segregation of P in the steel into ferrite grain boundaries. Slower cooling than specified above makes P precipitate into ferrite boundaries during cooling, resulting in a higher fracture appearance transition temperature (vTrs) measured by impact tests, and the resulting steel sheet is poor in hole expandability.

The cooling rate mentioned above may be attained in any manner without specific restrictions. Possible cooling methods include blast air cooling by blowers, blowing with mist-containing blast air, water spraying through spraying nozzles, and dipping in a water bath.

Embodiment 2

The present inventors carried out extensive studies from every angle in order to realize the high-strength hot-rolled steel sheet with excellent hole expandability. As the result, it was found that a steel sheet with a tensile strength no lower than 780 MPa is realized if it has an adequate chemical composition and it is produced in such a way that its microstructure is composed of ferrite single phase containing therein fine precipitates of TiC and/or Nb and Mo carbides. In addition, it was also found that the hot-rolled steel sheet has good hole expandability if the coiled steel sheet is cooled under adequate conditions so that it has an adequate fracture appearance transition temperature (vTrs) measured by impact tests. These findings led to the present invention. The effect of the present invention will be described with reference to the way in which the present invention was completed.

If a steel sheet having a tensile strength no lower than 780 MPa is to have improved drawability and hole expandability, it should contain as little carbon as possible, have the ferrite structure as the main phase, and contain the solid solution-hardened or precipitation-hardened structure, so that the resulting steel sheet has a uniform structure and hardness. This is a probable reason for the steel sheet having high elongation and good hole expandability. However, hole expandability varies from one coil to another even though the hot-rolled steel sheet is the same in composition and manufacturing condition.

The present inventors investigated the relation between the hole expandability and the fracture appearance transition temperature (vTrs) measured by impact tests on the assumption that the former is related with toughness. The existence of a close relation between them was found. The results of investigation suggest that good hole expandability (larger than 60%) is obtained if the steel sheet is produced such that it has a fracture appearance transition temperature (vTrs) no higher than 0° C. (See FIGS. 5 and 7.) The hole expandability is measured by the method mentioned later.

A sample of steel sheet with a high fracture appearance transition temperature (vTrs) (or a low value of toughness or) was examined in more detail. The results indicate that low-temperature fracture leads to intergranular fracture and intergranular segregation of P takes place in intergranular fracture surfaces according to auger analysis. By contrast, a sample of steel sheet with good toughness (or a low fracture appearance transition temperature) merely undergoes cleavage fracture even in case of low-temperature fracture, without intergranular segregation of any element.

Figure 8:
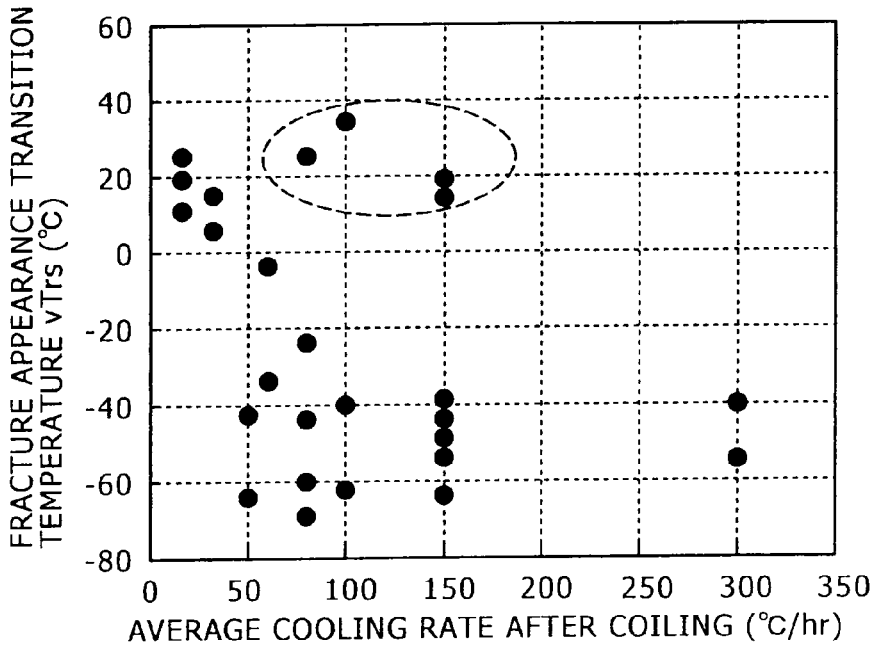
FIG. 8 is a graph showing the relation between cooling rate after coiling and the fracture appearance transition temperature (vTrs) in Example 4.

It is considered that segregation of P in grain boundaries is due to the fact that grain boundaries become more unstable than the inside of grains when the steel coil is cooled slowly. The present inventors continued their studies in the belief that toughness can be improved by suppressing segregation of P. The present inventors continued their researches assuming that the object would be achieved by reducing time for diffusion and pursued practical means from every angle. The results of their researches indicate that a hot-rolled steel sheet decreases in fracture appearance transition temperature (vTrs) and increases in toughness if it is cooled after coiling at an average cooling rate no smaller than 50° C./hr until it is cooled to a temperature below 300° C. (See FIGS. 6 and 8.)

The hot-rolled steel sheet according to the present invention is required to have an adequately controlled chemical composition so that it exhibits desirable fundamental mechanical properties, such as yield strength (YS), tensile strength (TS), and elongation (EL). The range of chemical composition specified in the present invention was established for the following reasons.

C: 0.02 to 0.10%

C is a basic component (element) to impart strength. For the steel sheet to have a tensile strength no lower than 780 MPa, it should contain C in an amount no less than 0.02%. However, with a C content exceeding 0.10%, the steel sheet is poor in hole expandability because it allows its microstructure to produce a second phase (such as pearlite, bainite, and martensite) other than ferrite. The C content should preferably be no higher than 0.03% and no lower than 0.06%.

Si: No More than 1.5% (Excluding 0%)

Si promotes the formation of polygonal ferrite and keeps strength without reducing elongation and hole expandability. This effect is proportional to the Si content; however, excessive Si deteriorates the surface state of steel sheets and increases resistance to deformation during hot rolling, thereby hindering smooth production of steel sheets. The Si content should be no more than 1.5%. It should preferably be no less than 0.2% and no more than 1.0%.

Mn: 0.5 to 2.0%

Mn is necessary for solution-hardening of steel. For the steel sheet to have a tensile strength no lower than 780 MPa, it should contain Mn in an amount of at least 0.5%. However, excessive Mn enhances hardenability too much and gives rise to a large amount of transformation products, thereby adversely affecting hole expandability. The Mn content should be no more than 2.0%. It should preferably be no less than 0.7% and no more than 1.9%.

P: No More than 0.025% (Excluding 0%)

P enhances solution-hardening without adverse effect on ductility. P plays an important role in the present invention. However, excessive P segregates in grain boundaries during cooling after coiling, thereby deteriorating toughness and increasing the fracture appearance transition temperature (vTrs). Therefore, the P content should be no more than 0.025%. It should preferably be no more than 0.015%.

S: No More than 0.01% (Including 0%)

S is an element that inevitably enters during the manufacturing process. It forms sulfide inclusions, which adversely affect hole expandability. Therefore, the S content should be as low as possible, or no more than 0.01%. It should be no more than 0.005%, preferably no more than 0.003%.

Al: 0.02 to 0.15%

Al is an element that is added for deoxidation during steel melting; it effectively improves the cleanliness of steel. For Al to produce its effect, it should be added in an amount no less than 0.02%. However, excessive Al gives rise to a large amount of alumina inclusions, which deteriorates the steel surface. Therefore, the Al content should be no more than 0.15%. It should preferably be no less than 0.03% and no more than 0.06%.

Ni: No More than 1% (Excluding 0%)

Ni enhances solution-hardening. However, excessive Ni is wasted without additional effects. The Ni content should be no more than 1%. Ni produces its effect in proportion to its content. For the steel sheet with ferrite single-phase structure to have a tensile strength no lower than 780 MPa, the Ni content should be at least 0.1%, preferably no less than 0.3%. Also, the Ni content should be no more than 0.8%, preferably no more than 0.6%.

Cr: No More than 1% (Excluding 0%)

Cr allows C to precipitate in steel for precipitation hardening and strengthens ferrite. However, excessive Cr is wasted without additional effects. The Cr content should be no more than 1%. Cr produces its effect in proportion to its content. For Cr to produce its effect, the Cr content should be no less than 0.1%, preferably no less than 0.3%. Also, the Cr content should be no more than 0.8%, preferably no more than 0.5%.

Nb: No More than 0.08% (Excluding 0%)

Nb makes fine the ferrite which has occurred from austenite after hot rolling, thereby improving hole expandability. It also causes C and N to precipitate in steel for precipitation hardening, thereby strengthening ferrite. It produces its effect more in proportion to its content. However, excessive Nb is wasted without additional effects. The Nb content should be no more than 0.08%. For Nb to produce its effect as mentioned above, the Nb content should be no less than 0.01%, preferably no less than 0.06%. The upper limit of the Nb content should be 0.06%, preferably 0.05%.

Ti: 0.05 to 0.2%

Ti causes C and N to precipitate in ferrite allowing ferrite to undergo precipitation hardening and decreases the amount of dissolved C and cementite in ferrite, thereby improving hole expandability. It plays an important role for the steel sheet to have a tensile strength no lower than 780 MPa. For these effects, the Ti content should be no less than 0.05%. However, excessive Ti deteriorates ductility and produces no additional effects. The Ti content should be no more than 0.2%. It should preferably be no less than 0.08% and no more than 0.15%.

The hot-rolled steel sheet according to the present invention is composed of the above-mentioned components and Fe, with the remainder being inevitable impurities (such as V and Sn). However, it may additionally contain any of optional elements such as Mo, Cu, B and Ca, according to need. The range of their content was established for the following reasons.

Mo: No More than 0.5% (Excluding 0%)

Mo precipitates in ferrite in the form of carbide, and it plays an important role in the precipitation hardening of ferrite. It also prevents P from segregating in ferrite grain boundaries. Segregation of P reduces toughness and increases the fracture appearance transition temperature (vTrs). The amount of Mo necessary for its effect should be so established as to satisfy the equation (1) below.

$$([Mo]/96)/([P]/31) \geqq 1.0 \quad (1)$$

where, [Mo] and [P] represent the content (in wt %) of Mo and P, respectively. Mo produces its effect in proportion to its content but excessive Mo does not produce additional effect. The adequate Mo content should be no more than 0.5%.

Cu: No More than 1.0% (Excluding 0%)

Cu enhances the mechanical strength of steel and improves the quality of steel. It produces its effect more in proportion to its content. However, excessive Cu deteriorates workability. An adequate Cu content is no more than 1.0%. For Cu to be fully effective, its content should preferably be no less than 0.05% and no more than 0.5%.

B: No More than 0.01% (Excluding 0%)

B reduces intergranular energy of steel and prevents intergranular segregation of P. It produces its effect more in proportion to its content. However, excess B does not produce additional effect. A desirable B content is no more than 0.01%. The desirable lower limit and upper limit of B content is 0.001% and 0.005%, respectively.

Ca: No More than 0.005% (Excluding 0%)

Ca makes sulfides in steel sheet spherical, thereby improving hole expandability. Since excessive Ca does not produce additional effect, an adequate content of Ca should be no more than 0.005%. For Ca to be fully effective, the Ca content should be no less than 0.001%. The upper limit of Ca content is 0.004%.

The steel sheet according to the present invention should have a microstructure composed substantially of ferrite single phase. The term "substantially of ferrite single phase" means that the ferrite phase accounts for at least 90% by area. Consequently, the steel sheet according to the present invention does not contain the structures of pearlite, bainite, martensite, and residual austenite (no more than 10% by area). The term "ferrite" in the present invention embraces polygonal ferrite and pseudo-polygonal ferrite. The "ferrite" termed in the present invention excludes acicular ferrite and bainitic ferrite, both of which have a high density of transformation which is unsuitable for high ductility.

The manufacturing method according to the present invention will be described below. The method for producing the high-strength hot-rolled steel according to the present invention needs an adequate control for cooling rate after coiling, as mentioned above. Except for cooling rate, ordinary conditions are applied to hot rolling. Basic conditions for the manufacturing method are as follows.

Production of the high-strength hot-rolled steel sheet according to the present invention starts with preparing a slab having the chemical composition as mentioned above in the usual way, and then the slab undergoes hot rolling into a steel sheet. Prior to hot rolling, the slab should be heated above 1150° C. so that Ti and Nb added to the steel completely dissolve in the steel. The resulting solid solution of Ti and Nb reacts with dissolved C and N in ferrite when ferrite is formed after completion of hot rolling, and the resulting compounds precipitate so that the steel undergoes precipitation hardening, which is necessary for the steel to have the desired tensile strength. The heating temperature should be no higher than 1300° C.; an excessively high heating temperature leads to damage to the heating furnace and increase in energy cost.

The hot rolling may be accomplished in the usual way without specific restrictions. However, the finish temperature of hot rolling should be higher than the $Ar_3$ transformation point at which the single phase of austenite exists. When the temperature of hot rolling is lower than the $Ar_3$ transformation point, the resulting steel sheet has the ferrite-austenite dual structure with worked ferrite remaining and hence is poor in ductility and hole expandability. Moreover, it has a coarse structure on its surface, resulting in poor elongation. In addition, hot rolling at a low temperature causes dissolved Nb and Ti to precipitate in the form of carbonitride, and the resulting precipitates do not contribute to strength. Precipitates in ferrite do not contribute to ferrite strength, and the amount for precipitation hardening (which is the original object of addition) decreases, thereby preventing the steel sheet from acquiring the desired strength.

After completion of hot rolling, the rolled steel sheet should be cooled at an average cooling rate greater than 30° C./s until it cools to the coiling temperature of 500-650° C. Cooling in this manner is necessary for the steel sheet to have a uniform fine bainite structure resulting from austenite. Cooling at an average cooling rate smaller than 30° C./s causes ferrite to become coarse after transformation, making the steel sheet poor in hole expandability.

The coiling temperature should be 500 to 650° C. so that the steel sheet has the microstructure of ferrite single phase. With a coiling temperature lower than 500° C., the steel sheet is poor in elongation due to entrance of bainite structure. In addition, it does not possess the desired strength due to shortage of carbonitrides for precipitation hardening. For the steel sheet to have better elongation, the coiling temperature should preferably be higher than 550° C.

By contrast, a coiling temperature exceeding 650° C. causes coarse carbides, nitrides, and carbonitrides (for precipitation hardening) to precipitate, thereby decreasing in strength. For this reason, the coiling temperature should be 500-650° C., preferably 550-650° C.

The coiled steel sheet should be cooled at an average cooling rate greater than 50° C./hr until it cools below 300° C. Cooling in this way is necessary to prevent segregation of P in the steel into ferrite grain boundaries. Slower cooling than specified above makes P precipitate into ferrite boundaries during cooling, resulting in a higher fracture appearance transition temperature (vTrs) measured by impact tests, and the resulting steel sheet is poor in hole expandability.

The cooling rate mentioned above may be attained in any manner without specific restrictions. Possible cooling methods include blast air cooling by blowers, blowing with mist-containing blast air, water spraying through spraying nozzles, and dipping in a water bath.

The invention will be described in more detail with reference to the following examples, which are not intended to restrict the scope thereof but may be modified in any way within the scope thereof.

Examples 1 and 2 correspond to Embodiment 1 mentioned above and Examples 3 and 4 correspond to Embodiment 2 mentioned above.

EXAMPLES

Example 1

Various samples of steel slabs having the chemical composition shown in Table 1 below were prepared. Each steel slab, which had been kept at 1250° C. for 30 minutes, was made into a hot-rolled steel sheet (4 mm thick) by hot rolling in the usual way, with the finish rolling temperature being 900° C. The hot-rolled steel sheet was cooled at an average cooling rate of 30° C./s and then coiled at 600° C. with heating by an electric furnace and aged at this temperature for 30 minutes. The coiled steel sheet was cooled in various ways at a specific cooling rate by a cooling furnace at an adequately controlled cooling rate, by standing, by blast air (with or without mist), by showering, or by dipping in a water bath. Thus there were obtained various samples of hot-rolled steel sheets.

TABLE 1

| Kind of steel | Chemical composition (wt %) | | | | | | | | | | | |
|---|---|---|---|---|---|---|---|---|---|---|---|---|
| | C | Si | Mn | P | S | Al | Ni | Cr | Mo | Nb | Ti | Remainder |
| A | 0.08 | 0.21 | 1.49 | 0.018 | 0.002 | 0.036 | 0.02 | 0.03 | 0.00 | 0.051 | 0.179 | Fe |
| B | 0.09 | 0.03 | 1.79 | 0.018 | 0.001 | 0.032 | 0.02 | 0.17 | 0.02 | 0.001 | 0.192 | Fe |

The thus obtained samples of hot-rolled steel sheets were cut into specimens conforming to JIS No. 5. The specimens were examined for mechanical properties (yield strength YS, tensile strength TS, and elongation EL) by impact test in direction which is perpendicular to the rolling direction (direction C). The samples of hot-rolled steel sheets were also examined for hole expandability in terms of the ratio of hole expandability (λ) measured in the following manner. They were also examined for fracture appearance transition temperature (vTrs) measured in the following manner. Their microstructure was observed under a scanning electron microscope after corrosion with nital in order to identify ferrite, bainite, and martensite. The area ratio of bainite was measured by means of an image analyzer. Incidentally, the impact test was performed on a subsize specimen (2.5 mm thick), with both sides ground.

ductile fracture. The percent brittle fracture was calculated from the following formula according to JIS.

$$B=C/A\times100(\%)$$

where, B denotes the percent brittle fraction (%), C denotes the area of brittle fracture, and A denotes the total area of fracture.

The percent brittle fracture is plotted against the test temperature, and the test temperature at which the percent brittle fracture is 50% on the curve is regarded as the fracture appearance transition temperature (vTrs).

The results of tests, together with the manufacturing conditions, are shown in Table 2. The results are graphically represented in FIG. 1 which shows the relation between the fracture appearance transition temperature (vTrs) and the ratio of hole expandability (λ) and FIG. 2 which shows the relation between the fracture appearance transition temperature (vTrs) and the cooling rate.

TABLE 2

| No. | Kind of steel | Hot-rolling finish temperature (° C.) | Coiling temperature (° C.) | Average cooling rate after coiling (° C./hr) | YS (N/mm$^2$) | TS (N/mm$^2$) | EL (%) | λ (%) | vTrs (° C.) | Microstructure (bainite area ratio %) |
|---|---|---|---|---|---|---|---|---|---|---|
| 1-1 | 1-A | 900 | 500 | 15 | 764 | 831 | 17 | 42 | 30 | 85 |
| 1-2 | 1-A | 900 | 500 | 30 | 711 | 800 | 18 | 52 | 20 | 83 |
| 1-3 | 1-A | 900 | 500 | 50 | 755 | 812 | 19 | 69 | −30 | 87 |
| 1-4 | 1-B | 900 | 500 | 80 | 768 | 816 | 19 | 73 | −40 | 85 |
| 1-5 | 1-A | 900 | 500 | 100 | 768 | 831 | 18 | 84 | −55 | 85 |
| 1-6 | 1-A | 900 | 500 | 150 | 764 | 824 | 19 | 87 | −60 | 88 |
| 1-7 | 1-B | 900 | 500 | 140 | 730 | 840 | 18 | 77 | −45 | 84 |
| 1-8 | 1-B | 900 | 500 | 300 | 804 | 867 | 18 | 87 | −40 | 86 |
| 1-9 | 1-A | 900 | 500 | 150 | 749 | 807 | 19 | 79 | −45 | 84 |
| 1-10 | 1-A | 900 | 500 | 300 | 764 | 826 | 18 | 89 | −55 | 87 |
| 1-11 | 1-A | 900 | 500 | 80 | 748 | 810 | 19 | 73 | −35 | 84 |

Method for Measuring the Ratio of Hole Expandability

A specimen is punched to make a hole with an initial diameter ($d_0$) of 10 mm. The hole is expanded by means of a conical punch (60°), which is pushed against the punching side, until cracks pass across the thickness of the specimen. The expanded diameter (d) is measured, and the ratio of hole expandability (λ) is calculated from the following formula.

$$\lambda=\{(d-d_0)/d_0\}\times100(\%)\quad d_0=10\text{ mm}$$

Method for Measuring Fracture Appearance Transition Temperature (vTrs)

An impact test specimen conforming to JIS No. 4 is prepared by machining. The specimen undergoes impact test according to JIS Z2242, and the percent brittle fracture (or the percent ductile fracture) is obtained according to JIS. The percent brittle fracture is plotted against test temperatures, and the test temperature at which the percent brittle fracture is 50% is regarded as the fracture appearance transition temperature (vTrs).

In particular, the test temperature (or specimen temperature) was changed at intervals of 10° C. or 20° C. and controlled under the conditions specified in JIS Z2242. After impact tests, the fractured specimen was observed to distinguish between the region of brittle fracture and the region of It is apparent from FIG. 1 that there is a close correlation between the fracture appearance transition temperature (vTrs) and the ratio of hole expandability (λ). This result suggests that the fracture appearance transition temperature (vTrs) should be no higher than 0° C. in order that the steel sheet has the ratio of hole expandability as desired (λ=60%). The steel sheet is rated as good in hole expandability if it has the ratio of hole expandability (λ) no smaller than 60%. This value is an indication that the high-strength hot-rolled steel sheet meets the requirements for machining into parts.

Figure 2:
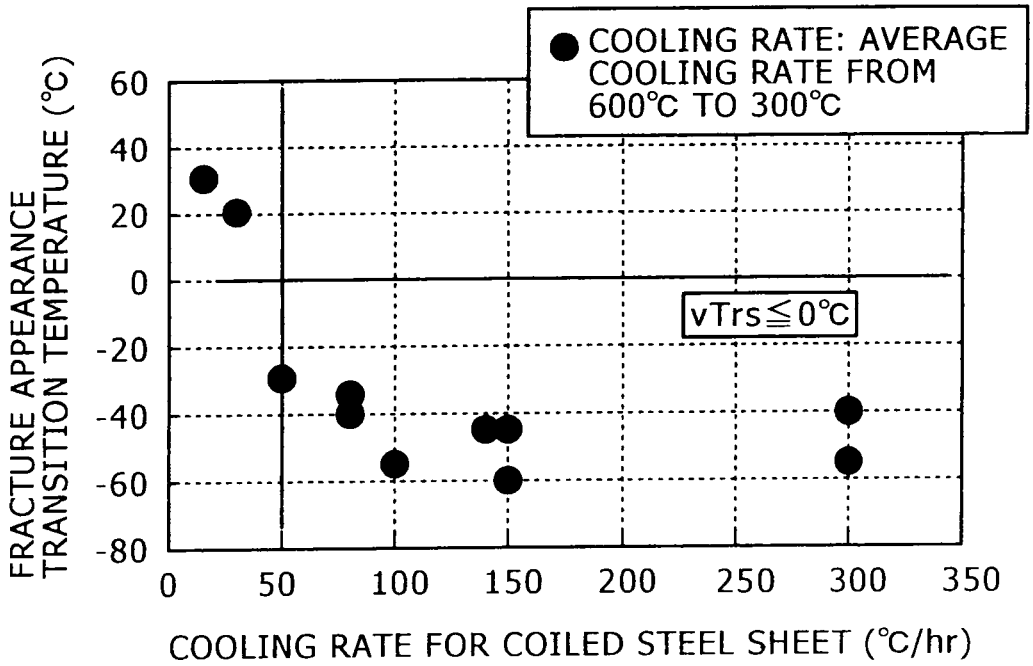
FIG. 2 is a graph showing the relation between cooling rate after coiling and the fracture appearance transition temperature (vTrs) in Example 1.

It is also apparent from FIG. 2 that the fracture appearance transition temperature (vTrs), which affects the ratio of hole expandability (λ), varies depending on the cooling rate at which the coiled steel sheet is cooled. It is noted that the average cooling rate should be no smaller than 50° C./hr for the fracture appearance transition temperature (vTrs) to be no higher than 0° C.

The impact test specimen was examined for fracture surface under an SEM. It was found that the specimen with a high vTrs has intergranular fracture in the brittle fracture surface, whereas the specimen with a low vTrs has cleavage fracture in the brittle fracture surface. The intergranular fracture was examined by auger electron spectroscopy. The result indicates the existence of concentrated P in grain boundaries. This suggests that P segregates in ferrite grain boundaries to reduce the toughness of the matrix material and the reduced toughness permits propagation of the crack that occurs during the test for hole expandability, which means that the steel sheet is poor in characteristic properties. It is concluded from the foregoing that controlling the cooling rate for the coiled steel sheet prevents P which has segregated in ferrite grain boundaries from diffusion, thereby allowing the steel sheet to have a high ratio of hole expandability.

Example 2

Various samples of steel slabs having the chemical composition shown in Table 3 below were prepared. Each steel slab, which had been kept at 1250° C. for 30 minutes, was made into a hot-rolled steel sheet (4 mm thick) by hot rolling in the usual way, with the finish rolling temperature being 900-930° C. The hot-rolled steel sheet was cooled at an average cooling rate of 30° C./s and then coiled at 450-650° C. with heating by an electric furnace and aged at this temperature for 30 minutes. The coiled steel sheet was cooled in various ways at a specific cooling rate by a cooling furnace at an adequately controlled cooling rate, by standing, by blast air (with or without mist), by showering, or by dipping in a water bath. Thus there were obtained various samples of hot-rolled steel sheets.

TABLE 3

| Kind of | Chemical composition (wt %) | | | | | | | | | | | | |
|---|---|---|---|---|---|---|---|---|---|---|---|---|---|
| steel | C | Si | Mn | P | S | Al | Ni | Cr | Mo | Nb | Ti | Others | Remainder |
| 1-C | 0.084 | 0.18 | 1.46 | 0.014 | 0.002 | 0.040 | 0.02 | 0.02 | 0.1 | 0.05 | 0.156 | — | Fe |
| 1-D | 0.085 | 0.18 | 1.45 | 0.015 | 0.002 | 0.042 | 0.01 | 0.03 | 0.21 | 0.051 | 0.162 | — | Fe |
| 1-E | 0.086 | 0.24 | 1.71 | 0.014 | 0.002 | 0.052 | 0.01 | 0.03 | 0.05 | 0.051 | 0.150 | Ca: 0.0018 | Fe |
| 1-F | 0.079 | 0.48 | 2.29 | 0.016 | 0.002 | 0.033 | 0.02 | 0.03 | 0.01 | 0.059 | 0.173 | Ca: 0.0025 | Fe |
| 1-G | 0.092 | 0.20 | 1.77 | 0.016 | 0.002 | 0.048 | 0.30 | 0.02 | 0 | 0.053 | 0.128 | Cu: 0.5 | Fe |
| 1-H | 0.084 | 0.19 | 1.71 | 0.015 | 0.002 | 0.029 | 0.01 | 0.02 | 0 | 0.055 | 0.088 | B: 0.0017 | Fe |
| 1-I | 0.06 | 1.0 | 1.45 | 0.014 | 0.002 | 0.036 | 0.01 | 0.02 | 0 | 0.060 | 0.165 | — | Fe |
| 1-J | 0.04 | 1.8 | 2.8 | 0.014 | 0.002 | 0.054 | — | 0.02 | 0.20 | 0.001 | 0.085 | — | Fe |
| 1-K | 0.04 | 0.96 | 3.35 | 0.015 | 0.001 | 0.038 | 0.01 | 0.01 | 0.21 | 0.045 | 0.092 | — | Fe |
| 1-L | 0.04 | 0.20 | 1.50 | 0.050 | 0.003 | 0.035 | 0.02 | 0.01 | 0.18 | 0.035 | 0.120 | — | Fe |
| 1-M | 0.05 | 0.05 | 1.45 | 0.012 | 0.002 | 0.046 | 0.01 | 0.01 | 0.18 | 0.015 | 0.30 | — | Fe |
| 1-N | 0.20 | 0.20 | 1.36 | 0.015 | 0.002 | 0.058 | 0.01 | 0.01 | 0.10 | 0.01 | 0.120 | — | Fe |
| 1-O | 0.02 | 0.48 | 1.52 | 0.018 | 0.002 | 0.041 | 0.01 | 0.01 | 0 | 0.01 | 0.092 | — | Fe |

The thus obtained samples of hot-rolled steel sheets were cut into specimens conforming to JIS No. 5. The specimens were examined for mechanical properties (yield strength YS, tensile strength TS, and elongation EL) by impact test in the direction perpendicular to the rolling direction. The samples of hot-rolled steel sheets were also examined for hole expandability and fracture appearance transition temperature (vTrs) in the same way as in Example 1. The results of tests, together with the manufacturing conditions (hot rolling finish temperature, coiling temperature, and cooling rate after coiling), are shown in Table 4. The results are graphically represented in FIG. 3 which shows the relation between the fracture appearance transition temperature (vTrs) and the ratio of hole expandability (λ) and FIG. 4 which shows the relation between the fracture appearance transition temperature (vTrs) and the cooling rate.

TABLE 4

| No. | Kind of steel | Hot-rolling finish temperature (° C.) | Coiling temperature (° C.) | Average cooling rate after coiling (° C./hr) | YS ($N/mm^2$) | TS ($N/mm^2$) | EL (%) | λ (%) | vTrs (° C.) | Microstructure (bainite area ratio %) |
|---|---|---|---|---|---|---|---|---|---|---|
| 1-12 | 1-C | 900 | 525 | 50 | 707 | 790 | 18 | 68 | −35 | 83 |
| 1-13 | 1-C | 900 | 500 | 80 | 691 | 798 | 19 | 79 | −40 | 88 |
| 1-14 | 1-C | 930 | 475 | 100 | 738 | 819 | 18 | 82 | −45 | 90 |
| 1-15 | 1-C | 930 | 500 | 150 | 575 | 865 | 17 | 73 | −33 | 85 |
| 1-16 | 1-C | 930 | 500 | 15 | 800 | 850 | 17 | 45 | 25 | 83 |
| 1-17 | 1-D | 900 | 525 | 80 | 698 | 803 | 18 | 79 | −43 | 80 |
| 1-18 | 1-D | 900 | 475 | 150 | 746 | 818 | 18 | 82 | −45 | 93 |
| 1-19 | 1-D | 900 | 500 | 30 | 737 | 807 | 18 | 43 | 30 | 91 |
| 1-20 | 1-E | 900 | 525 | 80 | 826 | 857 | 20 | 82 | −50 | 90 |
| 1-21 | 1-E | 900 | 500 | 150 | 797 | 865 | 19 | 78 | −45 | 87 |
| 1-22 | 1-F | 900 | 525 | 300 | 778 | 864 | 18 | 79 | −40 | 85 |
| 1-23 | 1-F | 900 | 500 | 150 | 758 | 852 | 17 | 86 | −45 | 89 |
| 1-24 | 1-G | 930 | 500 | 150 | 745 | 806 | 20 | 70 | −35 | 88 |

TABLE 4-continued

| No. | Kind of steel | Hot-rolling finish temperature (° C.) | Coiling temperature (° C.) | Average cooling rate after coiling (° C./hr) | YS (N/mm$^2$) | TS (N/mm$^2$) | EL (%) | λ (%) | vTrs (° C.) | Microstructure (bainite area ratio %) |
|---|---|---|---|---|---|---|---|---|---|---|
| 1-25 | 1-G | 930 | 475 | 300 | 743 | 799 | 20 | 72 | −30 | 95 |
| 1-26 | 1-G | 930 | 500 | 15 | 744 | 802 | 20 | 49 | 15 | 90 |
| 1-27 | 1-H | 900 | 525 | 150 | 718 | 798 | 20 | 78 | −40 | 87 |
| 1-28 | 1-H | 900 | 500 | 80 | 715 | 794 | 19 | 82 | −35 | 85 |
| 1-29 | 1-H | 900 | 500 | 15 | 708 | 796 | 19 | 46 | 20 | 88 |
| 1-30 | 1-I | 900 | 525 | 50 | 730 | 820 | 20 | 65 | −20 | 82 |
| 1-31 | 1-I | 900 | 500 | 80 | 728 | 818 | 19 | 87 | −35 | 83 |
| 1-32 | 1-J | 900 | 525 | 30 | 783 | 880 | 14 | 52 | 10 | 85 |
| 1-33 | 1-J | 900 | 500 | 150 | 766 | 870 | 13 | 48 | 15 | 87 |
| 1-34 | 1-K | 900 | 500 | 150 | 792 | 890 | 13 | 53 | 10 | 88 |
| 1-35 | 1-K | 900 | 475 | 80 | 837 | 930 | 11 | 45 | 20 | 90 |
| 1-36 | 1-L | 900 | 500 | 100 | 761 | 865 | 17 | 51 | 10 | 85 |
| 1-37 | 1-M | 900 | 500 | 100 | 739 | 840 | 12 | 43 | 25 | 83 |
| 1-38 | 1-N | 900 | 600 | 80 | 782 | 917 | 11 | 67 | −10 | 60 |
| 1-39 | 1-O | 900 | 600 | 80 | 612 | 657 | 24 | 79 | −60 | 65 |

Figure 3:
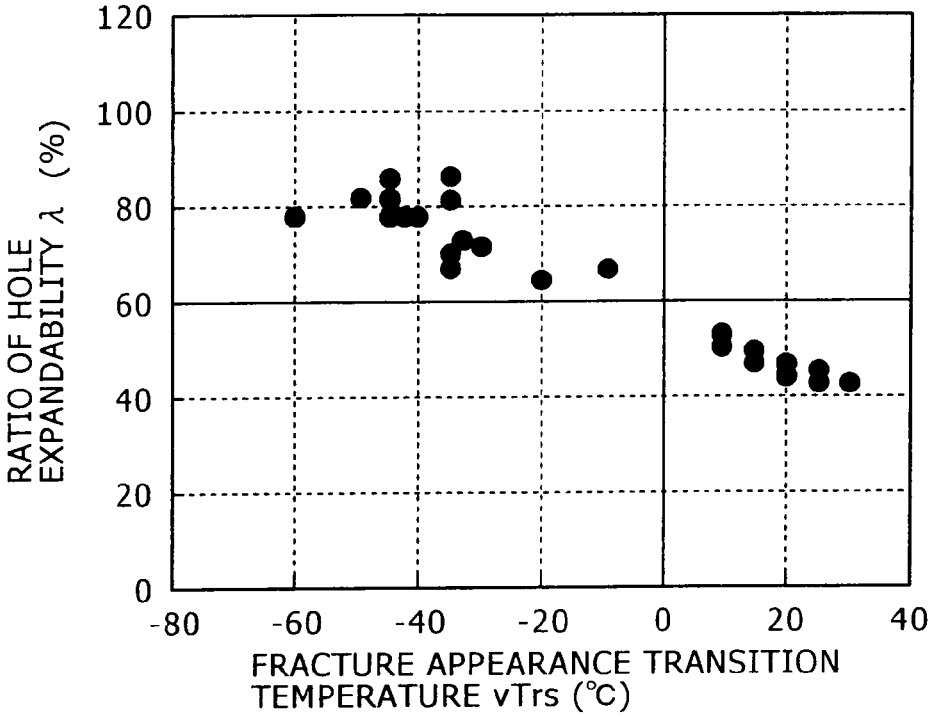
FIG. 3 is a graph showing the relation between the fracture appearance transition temperature (vTrs) and the hole expanding ratio (λ) in Example 2.

It is apparent from FIG. 3 that there is a close correlation between the fracture appearance transition temperature (vTrs) and the ratio of hole expandability (λ), as in the case of Example 1. This result suggests that the fracture appearance transition temperature (vTrs) should be no higher than 0° C. in order that the steel sheet has the ratio of hole expandability as desired (λ=60%). It is also apparent from FIG. 4 that the fracture appearance transition temperature (vTrs), which affects the ratio of hole expandability (λ) varies depending on the cooling rate at which the coiled steel sheet is cooled. It is noted that the average cooling rate should be no smaller than 50° C./hr for the fracture appearance transition temperature (vTrs) to be no higher than 0° C. Incidentally, the area surrounded by a dotted line in FIG. 4 denotes those samples which have higher fracture appearance transition temperatures (vTrs) because their chemical composition is outside the range specified in the present invention.

The foregoing suggests the following. Samples Nos. 1-12 to 1-15, 1-17, 1-18, 1-20 to 1-25, 1-27, 1-28, 1-30, and 1-31, which meet all the requirements specified in the present invention, are good in both mechanical properties and hole expandability. These samples represent the high-strength hot-rolled steel sheet with good workability, which accords with the present invention.

By contrast, samples Nos. 1-16, 1-19, 1-26, 1-29, and 1-32 to 1-39, which do not meet any one of the requirements specified in the present invention, are poor in both mechanical properties and hole expandability.

Samples Nos. 1-16, 1-19, 1-26, and 1-29 are poor in hole expandability because of the high fracture appearance transition temperature (vTrs), which resulted from the small average cooling rate for the coiled steel sheet. Also, samples Nos. 1-32 and 1-33, which are based on steel 1-J in Table 3, containing excess Si, are poor in hole expandability because of high fracture appearance transition temperature (vTrs).

Samples Nos. 1-34 and 1-35, which are based on steel 1-K in Table 3, containing excess Mn, are poor in hole expandability because of low ductility (elongation) and high fracture appearance transition temperature (vTrs). Sample No. 1-36, which is based on steel 1-L in Table 3, is poor in hole expandability because of high fracture appearance transition temperature (vTrs).

Samples Nos. 1-37 and 1-38, which are based on steel 1-M and 1-N, respectively, in Table 3, containing excess Ti and C, respectively, are poor in ductility (elongation). Sample No. 1-39, which is based on steel 1-O in Table 3, containing insufficient C, is poor in tensile strength.

Example 3

Various samples of steel slabs having the chemical composition shown in Table 5 below were prepared. Each steel slab, which had been kept at 1250° C. for 30 minutes, was made into a hot-rolled steel sheet (4 mm thick) by hot rolling in the usual way, with the finish rolling temperature being 900° C. The hot-rolled steel sheet was cooled at an average cooling rate of 30° C./s and then coiled at 600° C. with heating by an electric furnace and aged at this temperature for 30 minutes. The coiled steel sheet was cooled in various ways at a specific cooling rate by a cooling furnace at an adequately controlled cooling rate, by standing, by blast air (with or without mist), by showering, or by dipping in a water bath. Thus there were obtained various samples of hot-rolled steel sheets.

TABLE 5

| Kind of | Chemical composition (wt %) | | | | | | | | | | | |
|---|---|---|---|---|---|---|---|---|---|---|---|---|
| steel | C | Si | Mn | P | S | Al | Ni | Cr | Mo | Nb | Ti | Remainder |
| 2-A | 0.04 | 0.04 | 1.37 | 0.005 | 0.001 | 0.054 | 0.01 | 0.10 | 0.20 | 0.017 | 0.099 | Fe |
| 2-B | 0.04 | 0.49 | 1.39 | 0.006 | 0.001 | 0.043 | 0.31 | 0.29 | 0.0 | 0.016 | 0.130 | Fe |

The thus obtained samples of hot-rolled steel sheets were cut into specimens conforming to JIS No. 5. The specimens were examined for mechanical properties (yield strength YS, tensile strength TS, and elongation EL) by impact test in direction which is perpendicular to the rolling direction (direction C). The samples of hot-rolled steel sheets were also examined for hole expandability in terms of the ratio of hole expandability (λ) measured in the following manner. They were also examined for fracture appearance transition temperature (vTrs) measured in the following manner. Their microstructure was observed under an optical microscope. Incidentally, the impact test was performed on a subsize specimen (2.5 mm thick), with both sides ground.

Method for Measuring the Ratio of Hole Expandability

A specimen is punched to make a hole with an initial diameter ($d_0$) of 10 mm. The hole is expanded by means of a conical punch (60°), which is pushed against the punching side, until cracks pass across the thickness of the specimen. The expanded diameter (d) is measured, and the ratio of hole expandability (λ) is calculated from the following formula.

$$\lambda=\{(d-d_0)/d_0\}\times 100(\%)\quad d_0=10\text{ mm}$$

Method for Measuring Fracture Appearance Transition Temperature (vTrs)

An impact test specimen conforming to JIS No. 4 is prepared by machining. The specimen undergoes impact test according to JIS Z2242, and the percent brittle fracture (or the percent ductile fracture) is obtained according to JIS. The percent brittle fracture is plotted against test temperatures, and the test temperature at which the percent brittle fracture is 50% is regarded as the fracture appearance transition temperature (vTrs). Detailed procedures are the same as explained in Example 1.

The results of tests, together with the manufacturing conditions, are shown in Table 6. The results are graphically represented in FIG. 5 which shows the relation between the fracture appearance transition temperature (vTrs) and the ratio of hole expandability (λ) and FIG. 6 which shows the relation between the fracture appearance transition temperature (vTrs) and the cooling rate.

Figure 5:
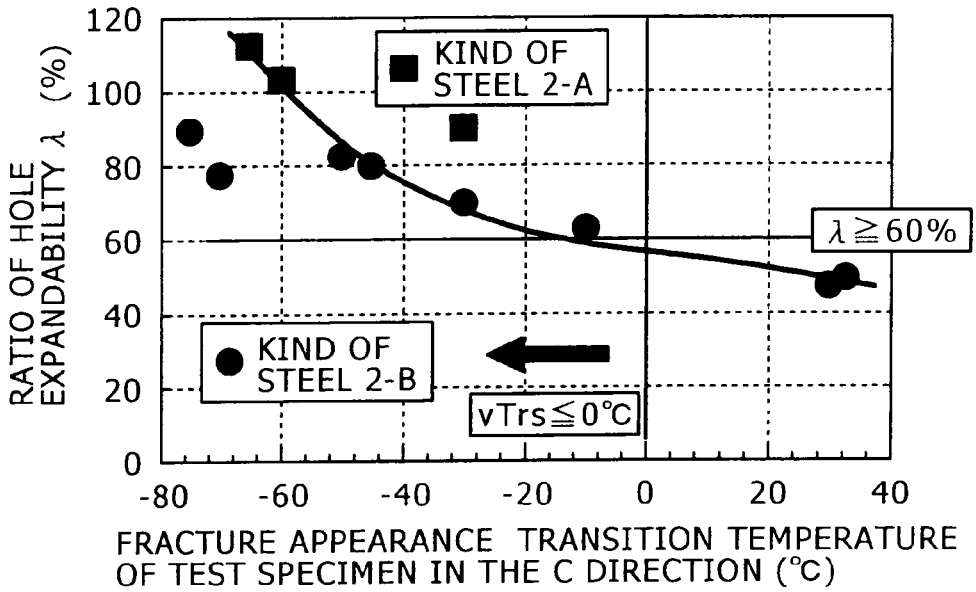
FIG. 5 is a graph showing the relation between the fracture appearance transition temperature (vTrs) and the hole expanding ratio (λ) in Example 3.

It is apparent from FIG. 5 that there is a close correlation between the fracture appearance transition temperature (vTrs) and the ratio of hole expandability (λ). This result suggests that the fracture appearance transition temperature (vTrs) should be no higher than 0° C. in order that the steel sheet has the ratio of hole expandability as desired (λ=60%). The steel sheet is rated as good in hole expandability if it has the ratio of hole expandability (λ) no smaller than 60%. This value is an indication that the high-strength hot-rolled steel sheet meets the requirements for machining into parts.

Figure 6:
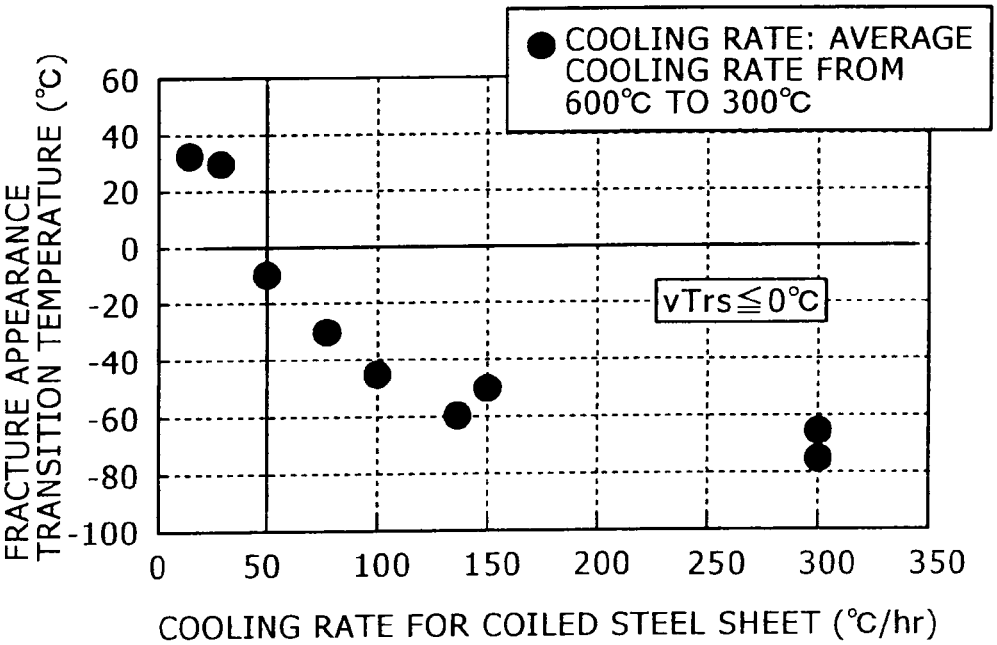
FIG. 6 is a graph showing the relation between cooling rate after coiling and the fracture appearance transition temperature (vTrs) in Example 3.

It is also apparent from FIG. 6 that the fracture appearance transition temperature (vTrs), which affects the ratio of hole expandability (λ), varies depending on the cooling rate at which the coiled steel sheet is cooled. It is noted that the average cooling rate should be no smaller than 50° C./hr for the fracture appearance transition temperature (vTrs) to be no higher than 0° C.

The impact test specimen was examined for fracture surface under an SEM. It was found that the specimen with a high vTrs has intergranular fracture in the brittle fracture surface, whereas the specimen with a low vTrs has cleavage fracture in the brittle fracture surface. The intergranular fracture was examined by auger electron spectroscopy. The result indicates the existence of concentrated P in grain boundaries. This suggests that P segregates in ferrite grain boundaries to reduce the toughness of the matrix material and the reduced toughness permits propagation of the crack that occurs during the test for hole expandability, which means that the steel sheet is poor in characteristic properties. It is concluded from the foregoing that controlling the cooling rate for the coiled steel sheet prevents P which has segregated in ferrite grain boundaries from diffusion, thereby allowing the steel sheet to have a high ratio of hole expandability.

Example 4

Various samples of steel slabs having the chemical composition shown in Table 7 below were prepared. Each steel slab, which had been kept at 1250° C. for 30 minutes, was made into a hot-rolled steel sheet (4 mm thick) by hot rolling in the usual way, with the finish rolling temperature being 900-930° C. The hot-rolled steel sheet was cooled at an average cooling rate of 30° C./s and then coiled at 450-650° C. with heating by an electric furnace and aged at this temperature for 30 minutes. The coiled steel sheet was cooled in various ways at a specific cooling rate by a cooling furnace at an adequately controlled cooling rate, by standing, by blast air (with or without mist), by showering, or by dipping in a water bath. Thus there were obtained various samples of hot-rolled steel sheets.

TABLE 6

| Test No. | Kind of steel | Hot-rolling finish temperature (° C.) | Coiling temperature (° C.) | Average cooling rate after coiling (° C./hr) | YS (N/mm$^2$) | TS (N/mm$^2$) | EL (%) | λ (%) | vTrs (° C.) | Microstructure |
|---|---|---|---|---|---|---|---|---|---|---|
| 2-1 | 2-B | 900 | 600 | 15 | 753 | 801 | 20 | 49 | 33 | Ferrite |
| 2-2 | 2-B | 900 | 600 | 30 | 777 | 827 | 19 | 47 | 30 | Ferrite |
| 2-3 | 2-B | 900 | 600 | 50 | 743 | 791 | 23 | 63 | −10 | Ferrite |
| 2-4 | 2-A | 900 | 600 | 80 | 745 | 801 | 21 | 90 | −30 | Ferrite |
| 2-5 | 2-B | 900 | 600 | 100 | 738 | 803 | 20 | 80 | −45 | Ferrite |
| 2-6 | 2-B | 900 | 600 | 150 | 760 | 818 | 20 | 83 | −50 | Ferrite |
| 2-7 | 2-A | 900 | 600 | 140 | 740 | 805 | 21 | 103 | −60 | Ferrite |
| 2-8 | 2-A | 900 | 600 | 300 | 743 | 808 | 21 | 112 | −65 | Ferrite |
| 2-9 | 2-B | 900 | 600 | 150 | 752 | 818 | 20 | 78 | −70 | Ferrite |
| 2-10 | 2-B | 900 | 600 | 300 | 758 | 824 | 20 | 90 | −75 | Ferrite |
| 2-11 | 2-B | 900 | 600 | 80 | 742 | 798 | 24 | 70 | −30 | Ferrite |

TABLE 7

| Kind of steel | Chemical composition (wt %) C | Si | Mn | P | S | Al | Ni | Cr | Mo | Nb | Ti | Others | Remainder |
|---|---|---|---|---|---|---|---|---|---|---|---|---|---|
| 2-C | 0.04 | 0.1 | 1.42 | 0.015 | 0.002 | 0.038 | 0.01 | 0.12 | 0.21 | 0.015 | 0.088 | — | Fe |
| 2-D | 0.04 | 0.45 | 1.31 | 0.013 | 0.002 | 0.041 | 0.31 | 0.30 | 0 | 0.014 | 0.130 | — | Fe |
| 2-E | 0.03 | 0.53 | 1.36 | 0.016 | 0.001 | 0.048 | 0.30 | 0.31 | 0.05 | 0.034 | 0.140 | Ca: 0.0022 | Fe |
| 2-F | 0.04 | 0.52 | 1.43 | 0.014 | 0.001 | 0.055 | 0.30 | 0.31 | 0.10 | 0.015 | 0.139 | Ca: 0.0018 | Fe |
| 2-G | 0.06 | 0.46 | 1.25 | 0.015 | 0.002 | 0.034 | 0.30 | 0.31 | 0.19 | 0.014 | 0.137 | Ca: 0.0025 | Fe |
| 2-H | 0.04 | 0.47 | 1.36 | 0.015 | 0.002 | 0.045 | 0.30 | 0.40 | 0.03 | 0.015 | 0.137 | B: 0.0018 | Fe |
| 2-I | 0.04 | 0.97 | 0.79 | 0.013 | 0.003 | 0.032 | 0.58 | 0.30 | 0.20 | 0.045 | 0.093 | Cu: 0.5 | Fe |
| 2-J | 0.04 | 1.52 | 1.83 | 0.014 | 0.002 | 0.044 | 0.01 | 0.02 | 0.20 | 0.001 | 0.085 | — | Fe |
| 2-K | 0.04 | 0.96 | 2.35 | 0.015 | 0.001 | 0.058 | 0.01 | 0.01 | 0.21 | 0.001 | 0.090 | — | Fe |
| 2-L | 0.04 | 0.2 | 1.50 | 0.050 | 0.003 | 0.033 | 0.02 | 0.01 | 0.18 | 0.001 | 0.120 | — | Fe |
| 2-M | 0.05 | 0.05 | 1.45 | 0.012 | 0.002 | 0.038 | 0.01 | 0.01 | 0.18 | 0.015 | 0.250 | — | Fe |
| 2-N | 0.12 | 0.2 | 1.36 | 0.015 | 0.002 | 0.046 | 0.01 | 0.01 | 0.10 | 0.001 | 0.120 | — | Fe |
| 2-O | 0.01 | 0.48 | 1.52 | 0.018 | 0.002 | 0.053 | 0.01 | 0.01 | 0 | 0.010 | 0.092 | — | Fe |

The thus obtained samples of hot-rolled steel sheets were cut into specimens conforming to JIS No. 5. The specimens were examined for mechanical properties (yield strength YS, tensile strength TS, and elongation EL) by impact test in the direction perpendicular to the rolling direction. The samples of hot-rolled steel sheets were also examined for hole expandability and fracture appearance transition temperature (vTrs) in the same way as in Example 3. The results of tests, together with the manufacturing conditions (hot rolling finish temperature, coiling temperature, and cooling rate after coiling), are shown in Table 8. The results are graphically represented in FIG. 7 which shows the relation between the fracture appearance transition temperature (vTrs) and the ratio of hole expandability (λ) and FIG. 8 which shows the relation between the fracture appearance transition temperature (vTrs) and the cooling rate.

Figure 7:
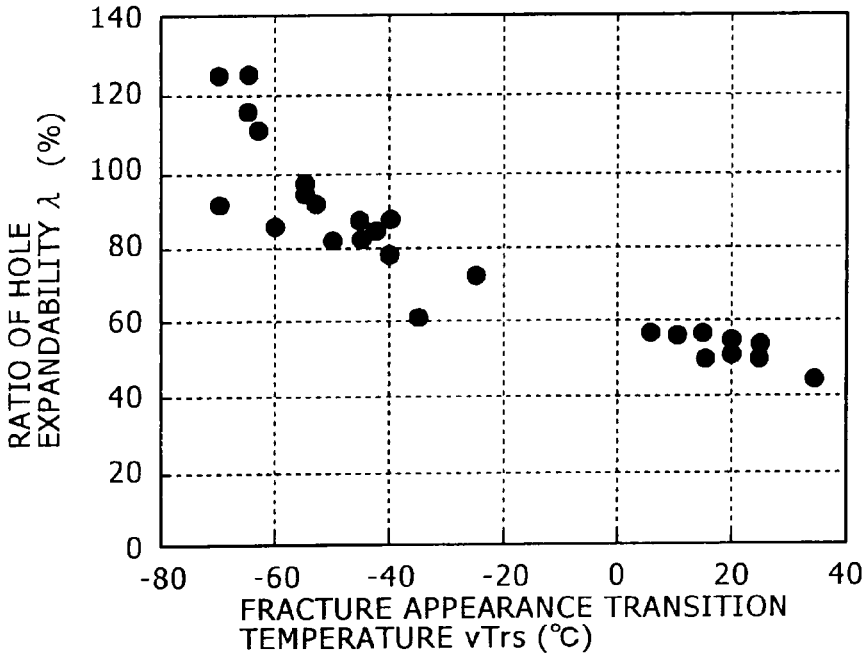
FIG. 7 is a graph showing the relation between the fracture appearance transition temperature (vTrs) and the hole expanding ratio (λ) in Example 4.

It is apparent from FIG. 7 that there is a close correlation between the fracture appearance transition temperature (vTrs) and the ratio of hole expandability (λ), as in the case of Example 3. This result suggests that the fracture appearance transition temperature (vTrs) should be no higher than 0° C. in order that the steel sheet has the ratio of hole expandability as desired (λ=60%). It is also apparent from FIG. 8 that the fracture appearance transition temperature (vTrs), which affects the ratio of hole expandability (λ), varies depending on the cooling rate at which the coiled steel sheet is cooled. It is noted that the average cooling rate should be no smaller than 50° C./hr for the fracture appearance transition temperature (vTrs) to be no higher than 0° C. Incidentally, the area surrounded by a dotted line in FIG. 8 denotes those samples which have higher fracture appearance transition temperatures (vTrs) because their chemical composition is outside the range specified in the present invention.

TABLE 8

| Test No. | Kind of steel | Hot-rolling finish temperature (° C.) | Coiling temperature (° C.) | Average cooling rate after coiling (° C./hr) | YS (N/mm$^2$) | TS (N/mm$^2$) | EL (%) | λ (%) | vTrs (° C.) | Microstructure |
|---|---|---|---|---|---|---|---|---|---|---|
| 2-12 | 2-C | 900 | 625 | 50 | 705 | 783 | 23 | 116 | −65 | Ferrite |
| 2-13 | 2-C | 900 | 600 | 80 | 715 | 796 | 22 | 125 | −70 | Ferrite |
| 2-14 | 2-C | 900 | 575 | 100 | 718 | 789 | 23 | 111 | −63 | Ferrite |
| 2-15 | 2-C | 930 | 600 | 150 | 719 | 790 | 23 | 125 | −65 | Ferrite |
| 2-16 | 2-C | 930 | 600 | 15 | 710 | 798 | 22 | 55 | 10 | Ferrite |
| 2-17 | 2-D | 900 | 625 | 80 | 748 | 813 | 20 | 82 | −45 | Ferrite |
| 2-18 | 2-D | 900 | 575 | 150 | 739 | 830 | 20 | 97 | −55 | Ferrite |
| 2-19 | 2-D | 900 | 600 | 30 | 736 | 803 | 21 | 55 | 15 | Ferrite |
| 2-20 | 2-E | 900 | 625 | 80 | 707 | 794 | 22 | 72 | −25 | Ferrite |
| 2-21 | 2-E | 900 | 600 | 150 | 736 | 800 | 21 | 87 | −45 | Ferrite |
| 2-22 | 2-F | 900 | 625 | 300 | 741 | 805 | 21 | 95 | −55 | Ferrite |
| 2-23 | 2-F | 900 | 600 | 150 | 739 | 830 | 20 | 92 | −53 | Ferrite |
| 2-24 | 2-G | 930 | 600 | 150 | 758 | 842 | 20 | 82 | −50 | Ferrite |
| 2-25 | 2-G | 930 | 575 | 300 | 760 | 853 | 20 | 78 | −40 | Ferrite |
| 2-26 | 2-G | 930 | 600 | 15 | 728 | 811 | 21 | 53 | 20 | Ferrite |
| 2-27 | 2-H | 900 | 625 | 150 | 762 | 847 | 20 | 87 | −40 | Ferrite |
| 2-28 | 2-H | 900 | 600 | 80 | 746 | 829 | 21 | 82 | −45 | Ferrite |
| 2-29 | 2-H | 900 | 600 | 15 | 776 | 800 | 19 | 49 | 25 | Ferrite |
| 2-30 | 2-I | 900 | 625 | 50 | 708 | 788 | 22 | 84 | −43 | Ferrite |
| 2-31 | 2-I | 900 | 600 | 80 | 737 | 810 | 20 | 92 | −70 | Ferrite |
| 2-32 | 2-J | 900 | 625 | 30 | 761 | 845 | 21 | 56 | 5 | Ferrite |
| 2-33 | 2-J | 900 | 600 | 150 | 773 | 840 | 19 | 50 | 20 | Ferrite |
| 2-34 | 2-K | 900 | 600 | 150 | 818 | 930 | 16 | 49 | 15 | Ferrite |
| 2-35 | 2-K | 900 | 575 | 80 | 805 | 916 | 15 | 52 | 25 | Ferrite |
| 2-36 | 2-L | 900 | 600 | 100 | 783 | 880 | 19 | 43 | 35 | Ferrite |
| 2-37 | 2-M | 900 | 600 | 100 | 803 | 890 | 16 | 78 | −40 | Ferrite |
| 2-38 | 2-N | 900 | 600 | 80 | 819 | 920 | 14 | 60 | −35 | Ferrite |
| 2-39 | 2-O | 900 | 600 | 80 | 602 | 692 | 28 | 85 | −60 | Ferrite |

The foregoing suggests the following. Samples Nos. 2-12 to 2-15, 2-17, 2-18, 2-20 to 2-25, 2-27, 2-28, 2-30, and 2-31, which meet all the requirements specified in the present invention, are good in both mechanical properties and hole expandability. These samples represent the high-strength hot-rolled steel sheet with good workability, which accords with the present invention.

By contrast, samples Nos. 2-16, 2-19, 2-26, 2-29, and 2-32 to 2-39, which do not meet any one of the requirements specified in the present invention, are poor in both mechanical properties and hole expandability.

Samples Nos. 2-16, 2-19, 2-26, and 2-29 are poor in hole expandability because of the high fracture appearance transition temperature (vTrs), which resulted from the small average cooling rate for the coiled steel sheet. Also, samples Nos. 2-32 and 2-33, which are based on steel 2-J in Table 7, containing excess Si, are poor in hole expandability because of high fracture appearance transition temperature (vTrs).

Samples Nos. 2-34 and 2-35, which are based on steel 2-K in Table 7, containing excess Mn, are poor in hole expandability because of low ductility (elongation) and high fracture appearance transition temperature (vTrs). Sample No. 2-36, which is based on steel 2-L in Table 7, is poor in hole expandability because of high fracture appearance transition temperature (vTrs).

Samples Nos. 2-37 and 2-38, which are based on steel 2-M and 2-N, respectively, in Table 7, containing excess Ti and C, respectively, are poor in ductility (elongation). Sample No. 2-39, which is based on steel 2-O in Table 7, containing insufficient C, is poor in tensile strength.

The invention claimed is:

1. A high-strength hot-rolled steel sheet containing (% in terms of % by weight):

C: 0.02 to 0.10%,

Si: no more than 1.50% (excluding 0%),

Mn: 0.5 to 2.0%, P: no more than 0.025% (excluding 0%),

S: no more than 0.01% (including 0%),

Al: 0.020 to 0.15%,

Ni: 0.1 to 1%,

Cr: 0.1 to 1%,

Nb: 0.01 to 0.08%, and

Ti: 0.05 to 0.2%, with the remainder comprising Fe and inevitable impurities;

which high-strength hot-rolled steel sheet is characterized in that its metallographic structure comprises ferrite of 90% by area or more, its fracture appearance transition temperature (vTrs) is no higher than 0° C. as obtained by impact tests, and its tensile strength is 780 MPa or more.

2. The hot-rolled steel sheet as defined in claim 1 which further contains Mo (no more than 0.5%, excluding 0%) such that the equation (1) below is satisfied;

$$([Mo]/96)/([P]/31) \geqq 1.0 \quad (1)$$

where, [Mo] and [P] represent the content (in wt %) of Mo and P, respectively.

3. The hot-rolled steel sheet as defined in claim 1, which further contains Cu: no more than 1.0% (excluding 0%).

4. The hot-rolled steel sheet as defined in claim 1, which further contains B: no more than 0.01% (excluding 0%).

5. The high-strength hot-rolled steel sheet according to claim 1, which has a ratio of hole expandability (λ) no smaller than 78% and a tensile strength no less than 800 MPa.

6. A method for producing the high-strength hot-rolled steel sheet defined in claim 1, said method comprising:

heating a steel slab containing the chemical components defined in claim 1, at 1150 to 1300° C., hot-rolling the heated steel slab at a finish temperature above $Ar_3$ transformation point, and cooling the hot-rolled steel sheet down to 500-650° C. at an average cooling rate no smaller than 30° C./sec, followed by coiling and cooling the coiled steel sheet down to a temperature no higher than 300° C. at an average cooling rate of 50-400° C./hour.

7. The high-strength hot-rolled steel sheet according to claim 1, which has a ratio of hole expandability (λ) no smaller than 60%.

8. The high-strength hot-rolled steel sheet according to claim 1, which has a ratio of hole expandability (λ) no smaller than 72% and a tensile strength no less than 783 MPa.

9. The high-strength hot-rolled steel sheet according to claim 1, which has a ratio of hole expandability (λ) no smaller than 82% and a tensile strength no less than 783 MPa.

10. The hot-rolled steel sheet as defined in claim 5, which further contains Ca: no more than 0.005% (excluding 0%).

11. The high-strength hot-rolled steel sheet according to claim 1, which has a ratio of hole expandability (λ) larger than 60%, a tensile strength no less than 780 MPa, and an elongation no lower than 20%.

* * * * *